US006630278B2

(12) United States Patent
Van den Zegel et al.

(10) Patent No.: US 6,630,278 B2
(45) Date of Patent: Oct. 7, 2003

(54) SYSTEM FOR DIRECT X-RAY RADIOGRAPHY SUITABLE FOR USE IN INDUSTRIAL NON-DESTRUCTIVE TESTING APPLICATIONS AND PERSONAL MONITORING

(75) Inventors: Marc Van den Zegel, Boortmeerbeek (BE); Marleen De Vester, Broechem (BE)

(73) Assignee: AGFA-Gevaert, Mortsel (BE)

( * ) Notice: Subject to any disclaimer, the term of this patent is extended or adjusted under 35 U.S.C. 154(b) by 75 days.

(21) Appl. No.: 09/955,673

(22) Filed: Sep. 19, 2001

(65) Prior Publication Data

US 2002/0064725 A1 May 30, 2002

Related U.S. Application Data

(60) Provisional application No. 60/245,290, filed on Nov. 2, 2000.

(30) Foreign Application Priority Data

Oct. 4, 2000 (EP) ..... 00203439

(51) Int. Cl.[7] ..... G03C 1/08; G03C 5/17; G03C 1/005

(52) U.S. Cl. ..... 430/139; 430/567; 430/569; 430/966; 430/967; 430/603; 430/605; 250/370.09; 250/370.1

(58) Field of Search ..... 430/139, 567, 430/569, 966, 967, 603, 605; 250/370.1, 370.07, 370.09, 475.2

(56) References Cited

U.S. PATENT DOCUMENTS

| | | | | | |
|---|---|---|---|---|---|
| 4,546,251 | A | * | 10/1985 | Schaffer | 250/252.1 |
| 5,171,659 | A | * | 12/1992 | Tsaur et al. | 430/569 |
| 5,440,130 | A | * | 8/1995 | Cox et al. | 250/370.9 |
| 5,444,756 | A | * | 8/1995 | Pai et al. | 378/98.8 |
| 5,567,943 | A | * | 10/1996 | Plevinsky | 250/368 |
| 5,576,168 | A | * | 11/1996 | Daubendiek et al. | 430/567 |
| 5,766,837 | A | | 7/1998 | Ozeki et al. | 430/567 |
| 5,965,337 | A | * | 10/1999 | Droin et al. | 430/440 |
| 6,030,757 | A | * | 2/2000 | Heremans et al. | 430/488 |
| 6,200,743 | B1 | * | 3/2001 | Elst et al. | 430/576 |
| 6,316,175 | B1 | * | 11/2001 | Van den Zegel et al. | 430/502 |

FOREIGN PATENT DOCUMENTS

| | | |
|---|---|---|
| GB | 758475 | 10/1956 |

* cited by examiner

*Primary Examiner*—Janet Baxter
*Assistant Examiner*—Amanda C. Walke
(74) *Attorney, Agent, or Firm*—Joseph T. Guy; Nexsen Pruet Jacobs & Pollard, LLC

(57) ABSTRACT

A system has been disclosed for use in radiographic industrial non-destructive testing materials and personal monitoring, making use therefor, of tabular silver brom (oiod)ide emulsion grains having {111} major faces, an average equivalent circular diameter of at least 0.5 $\mu$m and an average thickness of less than 0.30 $\mu$m, having been chemically sensitized by the steps of adding at least a gold salt in order to provide the surface of said tabular grains with at least 6000 atoms of gold per $\mu m^2$ of its grain surface and per (0.1 $\mu$m of thickness)$^2$; and at least a sulfite salt in such an amount that the ratio of the number of gold atoms per $\mu m^2$ and (concentration of said sulfite salt, expressed in mmole per mole of silver)$^2$ is at least 200000.

9 Claims, No Drawings

SYSTEM FOR DIRECT X-RAY RADIOGRAPHY SUITABLE FOR USE IN INDUSTRIAL NON-DESTRUCTIVE TESTING APPLICATIONS AND PERSONAL MONITORING

This application claims the benefit of Provisional Application No. 60,245,290 filed Nov. 2, 2000.

FIELD OF THE INVENTION

The present invention relates to a system for direct X-ray detection and image-formation suitable for use in radiographic industrial non-destructive testing materials and personal monitoring.

BACKGROUND OF THE INVENTION

Industrial radiography is a non-destructive technique for testing and analyzing defects in components such as glass, paper, wood or metal parts, etc. This technique is widely used in aeronautics, the nuclear industry or the petroleum industry since it makes it possible to detect welding defects or defects in the texture of materials in aircraft components, nuclear reactors or pipelines. This technique consists of exposing a component to be analyzed to an ionizing radiation, in general X or gamma rays having an energy between 10.000 and 15.000 kVp, either directly or by means of an intensifying screen. It is therefore necessary with this technique to use specific radiographic elements which are highly sensitive to this ionizing radiation. The major part of the ionizing radiation however passes through the silver halide grains without being absorbed and only a very small part of the incident radiation (less than 1%) is really absorbed and contributes to the formation of a developable latent image.

In order to really achieve high film sensitivity, also called "speed", which is an indispensible asset especially for direct-röntgen applications, efficient absorption of the exposure radiation is a prime condition. It has been shown empirically that for X-rays the mass absorption coefficient is proportional to a power of the atomic number Z as has been described in the "Encyclopaedic Dictionary of Physics" vol. 7, p. 787, eq. 10, Ed. J. Thewlis, Pergamom Press, Oxford 1957. This strongly favours the use of iodide (Z=54), more than bromide (Z=35) and further more than chloride (Z=17). As a consequence silver bromoiodide crystals have preferably been used hitherto. Absorption of the ionizing radiation can futher be enhanced by increasing the silver content and/or the thickness of the emulsion layers. Moreover it is common knowledge to provide double-side coated materials in favour of absorption of high energy radiation.

Cubic silver bromoiodide grains have until now preferably been used in non-destructive testing applications for the reason set out above, preferably coated in high amounts of more than 25 g/m2, expressed as equivalent amounts of silver nitrate, particularly when a higher speed is envisaged, as for those materials having grains with an average equivalent crystal diameter of at least 0.4 $\mu$m or an average equivalent volume of at least 0.034 $\mu m^3$. Lowering of coated amounts of silver thus results in a reduction of speed (sensitivity) for direct-Röngten rays and further leads to a lowering in contrast, which may be in favour of image quality (especially graininess) as desired for some well-designed applications, but makes maximum density decrease to an unacceptable level. When in such case only use can be made of radiation sources for X-rays having a lower energy output (exposure energies of about 100 kVp instead of the normally used 220 kVp) besides undesired higher contrasts a reduced speed can be expected. Although said reduced speed can be compensated in industrial radiographic exposure techniques by application of intensifying screens in contact with industrial non-destructive test film materials, thereby taking profit of the combined effect of direct-Röntgen exposure and exposure by light emitted from light-emitting phosphors present in the intensifying screens, the problem of too high contrasts remains in that case.

A suitable solution therefor has been presented in EP-A 0 890 875 and the corresponding U.S. Pat. No. 6,030,757 wherein a multilayer arrangement has been disclosed for a material suitable for e.g. concrete testing and wherein use was made, besides the well-known cubic grain emulsions, from tabular grain emulsions.

An indication of the applicability of tabular grain emulsions grains, known for practical applications in photography since the eighties, was already given before in dental X-ray applications in EP-A 0 653 670 and the corresponding U.S. Pat. No. 5,370,977.

Said tabular have however already been proposed in EP-A 0 757 286 and the corresponding U.S. Pat. No. 5,965,337 as effectively suitable for use in industrial non-destructive testing applications, moreover providing an improved speed. In the Examples of said EP-A 0 757 286 it has been established that high speed for such tabular grains is obtained after chemical sensitization thereof with sulphur and gold, the quantity of sulphur being between 30000 and 50000 atoms per $\mu m^2$ and of gold between 15000 and 50000 atoms per $\mu m^2$.

Apart from attaining the desired speed it is an indispensable asset to maintain a good developablity of the emulsion crystals present in the materials after exposure, even when the developer gets exhausted as commonly appears in the field after some working time. Within this aspect cubic grains offer a more expressed advantage over tabular grains. As developability, even under bare circumstances as exhaustion of processing solutions, is important with respect to consistency of the resulting diagnostic image, obtained after processing, it is of utmost importance to provide means in order to take away this disavantageous aspect which is related with the use of tabular grains, particularly in critical applications as in radiographic industrial non-destructive testing.

OBJECTS OF THE INVENTION

It has been an object of the present invention to provide a system for industrial non-destructive testing applications and personal monitoring, making use therefor of silver halide photographic film materials coated with tabular grain emulsions, offering high speed and minimum variation thereof, even after processing of said materials in exhausted processing solutions.

Other objects will become apparent from the description hereinafter.

SUMMARY OF THE INVENTION

The above mentioned objects have been realized by providing a system for direct X-ray radiography comprised of (1) a silver halide photographic element or material free from dyes spectrally sensitizing radiation sensitive emulsion grains coated in radiation sensitive layers thereof, said emulsion grains being tabular silver brom(oiod)ide grains with {111} major faces, an average equivalent circular diameter of at least 0.5 $\mu$m and an average thickness of less than 0.30 $\mu$m, accounting for at least 50% of the total projective area of all grains, said grains further having been chemically sensitized by the steps of adding at least a gold salt in order to provide the surface of said tabular grains with at least 6000 atoms of gold per $\mu m^2$ of its grain surface and en per (0.1 $\mu$m of thickness)$^2$; and adding at least a sulfite salt in such an amount that the ratio of the number of gold atoms per $\mu m^2$ and per (concentration of said sulfite salt, expressed in mmole per mole of silver)$^2$ is at least 200000;

and wherein said emulsion has been coated symmetrically in same emulsion layers at both sides of a double-side coated support, said element having, per side, an amount of silver, expressed as an equivalent amount of silver nitrate, in the range of from 5 up to 25 g/m$^2$;

said system further having, (2) disposed on opposite sides of said element, two intensifying screens designed to emit electrons when exposed to X- or γ-rays with an energy greater than or equal to 10 kVp.

It is however required to have a gold salt and a sulfite salt present in amounts of at least 0.010 mmole and 0.05 mmole per mole of silver (nitrate), respectively.

In a preferred embodiment according to the present invention said material is an industrial non-destructive testing material. In another preferred embodiment according to the present invention said element is a material for personal monitoring.

A personal electromagnetic radiation monitor wearable by a person in order to warn the person of a radiation hazard condition caused by electromagnetic radiation emanating from a source of electromagnetic radiation, and wherein said monitor essentially comprises an element or material suitable for use in the system described above, has also been disclosed.

Last but not least an image-forming method has been described, said method comprising the steps of exposing to X- or γ-rays with an energy greater than or equal to 10 kVp an element or material used in the system according to the present invention and processing the said element by the steps of developing, fixing, rinsing and drying.

Further advantages and embodiments of the present invention will become apparent from the following description.

DETAILED DESCRIPTION OF THE INVENTION

In the system as disclosed in the summary of the invention, a method is provided of chemical sensitization of tabular silver brom(oiod)ide emulsion grains having {111} major faces for use in an element for industrial radiography sensitive to X- or γ-rays, coated with less silver halide, if compared with an element having voluminous grains, in order to get a high speed and minimum variation thereof, even after processing of said materials in exhausted processing solutions. It is also compatible with ascorbic acid developers, which are known to be particularly advantageous and preferred from an ecological point of view.

The present invention is related with a direct X-ray radiographic element intended to be exposed to X- or γ-radiations having an energy greater than or equal to 10 kVp, which comprises a support covered on both sides with a silver halide emulsion layer in which at least 50 percent of the total grain projected area of all grains is accounted for by tabular grains having an average equivalent circular diameter of at least 0.50 $\mu$m and an average thickness of less than 0.30 $\mu$m (resulting in an aspect ratio of at least about 2) and a silver content of the radiographic element from 5 up to 25 g/m$^2$, and even preferably from 5 to at most 15 g/m$^2$. According to one embodiment, the average volume of the tabular grains is greater than 0.03 $\mu m^3$ and for irradiation having a higher energy, it is even recommended to have an average volume of at least 0.06 $\mu m^3$.

The radiographic element suitable for use in the system of the present invention can be exposed either directly or through an intensifying screen. In the scope of the present invention, an "intensifying screen" is a metal screen which enables the proportion of X-ray or γ-radiations absorbed by the silver halide grains to be increased. The X-rays interact with the intensifying screen, producing electrons in all directions. Some of these electrons will be absorbed by the silver halide grains in the emulsion layer in order to form latent image sites. By increasing the number of electrons emitted in the direction of the grains, the quantity of electrons absorbed by the grains is increased. As the "intensifying screen" is not comparable with a "luminescent phosphor screen" as is used in "indirect X-ray imaging" or "indirect radiography" (making use of intensifying screens having luminescent phosphors that emit light after having been exposed to X-rays, wherein said light further exposes the silver halide emulsion grains in the film material) the system according to the present invention remains a so-called "direct X-ray system".

When the radiographic element used in the system of the present invention is exposed to X- or γ-rays, the sensitivity (speed) obtained is notably higher than that obtained with a radiographic element consisting of three-dimensional grains, for an identical grain volume, even when thin tabular grains having a high aspect ratio are coated, opposite to the normally expected absorption reduction of X- or γ-rays by the said thin tabular grains, which permit the use of a silver content, being up to 25% lower than in the presence of emulsions with thick or three-dimensional grains of the elements for industrial radiography.

Tabular grains having {111} major faces, well-known since the eighties, have two parallel major faces wider than the other faces of the grain. Said grains are further characterized by their aspect ratio, defined as equivalent circular diameter (of a circle having same area as the grain) to thickness, measured from shadowed replicas under a well defined angle. Apart from the requirement to have an aspect ratio of at least about 2 and a total grain projected area of the tabular grains in an emulsion of at least 50%, more preferably at least 75% and still more preferably 90%, it is an essential feature of the present invention to have the {111} tabular emulsion grains subjected to chemical ripening or sensitization in the absence of spectrally sensitizing dyes, but in the presence of sensitizing compounds essentially comprising at least one gold salt in order to provide the surface of said tabular grains with at least 6000 atoms of gold per $\mu m^2$ of its grain surface and per (0.1 $\mu$m of thickness)$^2$; and at least a sulfite salt in such an amount that the ratio of the number of gold atoms per $\mu m^2$ and (concentration of said sulfite salt, expressed in mmole per mole of silver)$^2$ is at least 200000, in order to fully reach the objects of the present invention, more particularly with respect to a lower difference between speed in fresh and in exhausted chemistry of the developer after processing of the radiation exposed industrial radiographic film material wherein such an emulsion is coated in the photosensitive layers thereof. In a preferred embodiment according to the present invention said ratio is in the range from $0.2\times10^6$ up to $3.5\times10^6$. In a further preferred embodiment a gold salt is added in an amount of at least 0.010 mmole per mole of silver and a sulfite salt is added in an amount of at least 0.05 mmole per mole of silver.

Silver solvents have a regulating role therein, especially those comprising thiocyanate ions. From such combination of gold salts and sulfite in the chemical ripening step in order to provide the number of gold atoms at the surface of the tabular grain emulsions and the ratio of gold versus sulfite as claimed, it was never expected that it would provide such an improvement in developablity, more particularly in exhausted developer compositions.

Besides the noble metal sensitization with gold salts as an essential feature in the amounts as set forth hereinbefore, noble metal sensitization with another salt of a noble metal as e.g. iridium, palladium, platinum, preferably in minor amounts versus gold, may be applied. Examples of the gold sensitizers which are preferably used include chloroauric acid, goldsulfide, chloroaurate salts, aurithiocyanate and gold selenide. The amount of the gold sensitizer should be applied in order to specifically encounter the desired requirements set forth above.

Sulfur sensitization can be further be carried out with sulphur compounds like thiosulphates, thioureas, rhodamines, etc. The sulphur sensitizer can also be used in an amount of about $10^{-8}$ to $10^{-2}$ mole per mole silver halide. Selenium sensitization and even tellurium sensitization can optionally be applied, as has e.g. been disclosed in U.S. Pat. Nos. 5,273,874; 5,215,880; 5,561,033; 5,393,655; 5,547,829; 5,573,901; 5,888,717; 5,677,120; in EP-A's 0 404 142, 0 443 453 and 0 572 663, in GB-A 2,316,184, in DE 19924669 and in EP-A 1 070 986.

Reduction sensitization by means of a reducing compound like thiourea dioxide, hydrazine derivatives, sulphinic acid, polyamine compounds, stannous chloride, borane compounds, reductones like ascorbic acid, etc., may further be applied. Reduction sensitization can also be carried out at a low pAg or a high pH or at both and if desired at elevated temperature. This kind of sensitization is refered to 'silver ripening'. More information can be found in Research Disclosure, Vol. 307, No. 307105 and in P. Glafkides "Chimie et Physique Photographic", P. Montel-Paris, $5^{th}$ Ed., 1987.

Preparation of a photosensitive element suitable for use in the system according to the present invention comprises the step of chemically sensitizing under conditions of pAg in the range of 6 till 11, preferably between 7 and 10; in conditions of pH in the range of 3 to 10, preferably 4 to 8.5, while the temperature is in the range between 40 to 95° C., pre-ferably between 45 and 85° C., without however being limited thereto.

According to the present invention an emulsion is thus provided, said emulsion comprising a protective colloid and tabular silver brom(oiod)ide emulsion grains having {111} major faces, an average equivalent circular diameter of at least 0.5 $\mu$m and an average thickness of less than 0.30 $\mu$m, said tabular grains accounting for at least 50% of the total projective area of all grains, said grains being chemically sensitized according to the method as set forth to be suitable for use in the system according to the present invention. In a more preferred embodiment according to the present invention the said silver brom(oiod)ide emulsion grains have an average equivalent circular diameter of up to 2.0 $\mu$m and an average thickness of from 0.05 up to 0.25 $\mu$m. In an even more preferred embodiment said silver brom(oiod)ide emulsion grains have an average equivalent circular diameter of up to 2.0 $\mu$m and an average thickness of from 0.08 up to 0.22 $\mu$m. The tabular grains present in the emulsion according to the present invention may be monodisperse or polydisperse, preferably monodisperse. The monodispersity of the grains is defined by the variation coefficient, expressed as a percentage, and is equal to the ratio of the standard deviation of the grain population from the average value of equivalent circular diameter of the tabular grains and said average value of equivalent circular diameter. A variation coefficient of preferred monodisperse emulsions is less than about 25%, and even more preferably in the range from 10 to 20%. Such emulsion grains can be prepared e.g. according to the method described in EP-A's 0 506 947, 0 569 075, 0 577 886, 0 584 189, 0 953 868 and 1 014 175, without however being limited thereto.

The tabular silver halide grains essentially comprise silver bromide in an amount of at least 90 mole % of bromide, based on silver, and may optionally contain chloride in an amount of at most 10 mole %. A tabular grain emulsion in which at least 50 percent of total grain projected area is accounted for by silver brom(oiod)ide tabular grains having an iodide content of less than 5 mole %, based on silver, having an average aspect ratio of at least 2, and having a volume greater than 0.03 $\mu^3$ is desired. When the radiographic element is intended to be exposed to high-energy radiation (above 500 kVp), the volume of the tabular grains is preferably greater than 0.06 $\mu m^3$. Optionally chloride can be present, if desired but always in a concentration of at most 10%, based on silver. In a preferred embodiment said silver brom(oiod)ide tabular grains, coated in at least one photosensitive layer of the radiographic element suitable for use in the system of the present invention, have silver iodide in an amount of at most 1 mole % based on silver. In another embodiment according to the present invention said tabular grains have an average volume between 0.05 and 2 $\mu m^3$ and the aspect ratio is between 5 and 25. Further according to the present invention said element is coated with photosensitive emulsion crystals so that a silver content per coated side, expressed as an equivalent amount of silver nitrate, is between 5 and 25 g/$m^2$. Incorporation of iodide ions may further be provided by using aqueous solutions of inorganic salts thereof as e.g. potassium iodide, sodium iodide or ammonium iodide. Iodide ions can however also be provided by organic compounds releasing iodide ions as has e.g. been described in EP-A's 0 561 415, 0 563 701, 0 563 708, 0 649 052 and 0 651 284 and in WO 96/13759. Especially in order to obtain a more homogeneous iodide distribution over the crystal volume in the crystal lattice and over the whole crystal distribution, iodide ions provided by organic agents releasing iodide ions are preferred such as mono iodide acetic acid, mono iodide propionic acid, mono iodide ethanol and even hydrogels containing iodide ions, capable to generate iodide ions. Generation of iodide ions is triggered by changing the pH value in the reaction vessel during or, preferably, after addition of the said organic agent releasing iodide ions. Opposite to the addition of potassium iodide as a source of iodide ions the said organic compounds releasing iodide ions are leading to a more homogeneous iodide ion distribution over the different tabular crystals, thus avoiding undefined heterogeneities and irreproducibilities. Another method of triggering generation of iodide ions is performed by addition of sulfite ions to the reaction vessel. Combinations of inorganic and organic agents providing iodide ions may also be useful. Alternatively very fine silver iodide grains, having a grain diameter of about 0.05 $\mu$m may be added as a source of iodide ions (also in favour of uniformity of silver iodide distribution over the tabular grains as disclosed e.g. in U.S. Pat. No. 5,955,253), and even addition of $KI_3$ is not excluded (see e.g. U.S. Pat. No. 6,033,842. Although normally added during the precipitation step(s) said iodide ions can be added (in small amounts) during the chemical sensitization step (even in form of those small silver iodide grains as has e.g. been described in U.S. Pat. No. 5,411,849. The presence of iodide ions stabilizes the (111)-crystal faces. Although preferred with respect to intrinsic sensitivity or speed, it is recommended to limit average iodide concentrations to up to 5 mole % and even more preferably to limit them in the range from 0.1 mole % to 1.0 mole %, based on the total silver amount as higher concentrations retard development and lead to unsatisfactory sensi-tivities. Moreover the velocity of fixation can be disturbed and as a consequence residual coloration may be unavoidable.

Grain size distributions of silver brom(oiod)ide crystals over the light-sensitive emulsion are homogeneous or monodisperse by controlling the precipitation methods used. Metal ions or metal ion complexes also called dopants, commonly added in low amounts to the silver brom(oiod)ide crystals in whatever a stage of the preparation, generally have little influence on crystal distributions in the emulsions but may be added to cause advantageous effects with respect to reciprocity, pressure sensitization, etc., as has been described e.g. in U.S. Pat. No. 5,362,619; wherein fine AgI crystals have been added in the precipitation step.

Therefore it is very important to carefully controll pAg, temperature, dilution of the reaction vessel, presence of growth restrainers or growth accelerators, addition rate of added aqueous soluble silver salt and halide solutions during different precipitation steps (especially during the nucleation step during which e.g. less than 10% of the total amount of silver salt available is consumed and further during the at least one growth step during which at least 90% of the said silver salt is consumed), way of mixing and mixing or stirring rate in the reaction vessel during the different precipitation steps leads to homogeneous crystal size distributions having variation coefficients (defined as ratio between standard deviation and average diameter) of not more than 0.10 to 0.20 instead of the normally occurring variation coefficients between 0.20 and 0.30. Depending on the precipitation conditions more heterogeneous distributions can be obtained and may even be more advantageous e.g. from the point of view of exposure latitude but in order to obtain the same effect of e.g. an increasing exposure latitude is reached by making mixtures of different homogeneous emulsions having very low variation coefficients e.g. in the range from 0.05 to 0.15. This may lead to even more advantageous sensitometric characteristics (e.g. increased contrast) or image quality (e.g. granularity and/or sharpness) as has been illustrated e.g. in U.S. Pat. No. 4,446,228 and in EP-A 0 555 897.

For practical use thin tabular grains accounting for at least 50% of the total projective surface area of all grains, more preferred for at least 75% and, even more preferred, for at least 90%, are present.

The composition of the halide can change in the crystal in a continous or discontinous way. Emulsions containing crystals composed of various sections with different halide compositions are used for several photographic applications. So a structure with a difference in halide composition between the center and the rest of the crystal (what is called 'core-shell'-emulsion) or with more than two crystal parts differing in halide composition (called a 'band'-emulsion) may occur. The changes in halide composition can be realised by direct precipitation or in an indirect way by conversion where fine silver halide grains of a certain halide composition are dissolved in the presence of the so-called host grains forming a 'shell' or 'band' on the given grain.

The silver halide emulsion can be prepared in various ways by conventional methods. These methods always start with a nucleation step, followed by a grain growth step. In this last step of the emulsion preparation reactants are added to the reaction vessel in the form of solutions of silver and halide salts or in the form of preformed silverhalide nuclei or fine grains which easily dissolve in the precipitation medium.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing, decreasing or fluctuating rate, if desired in combination with stepwise delivery procedures. More details about the possible ways in making a silver halide emulsion which can principally be used in this invention are summarized in Research Disclosure No. 38957 (September 1996), section I-C.

Besides the individual reactants necessary to form silver halide crystals additional chemical metal salts can be added for occlusion in the crystal lattice. Such compound is replacing an appropriate amount of silver and halide ions in the silver halide lattice. These compounds, so-called "dopants", can be distinguished from the metal complexes which are added just before coating as an additive by EPR- or ENDOR-technique. These dopants can be used to modify the crystal structure or the crystal properties and can therefore be employed to influence many photographical properties like sensitivity, reciprocity failure, gradation, pressure sensitivity, fog, stability, etc. When coordination complexes or even oligomeric coordination complexes are used the different ligands bound at the central metal ion can be occluded in the crystal lattice too and in this way influence the photographic properties of the silver halide materials as well. Dopants when introduced in emulsions of the present invention are those which can act as a permanent or as a non-permanent electron trap.

The doping procedure itself can normally be executed at any stage during the grain growth phase of the emulsion preparation. It is important to know that the dopants can also be added in an indirect way by the addition of a dispersion containing very fine soluble silver halide grains or nuclei comprising the dopant. More additional information about the introduction and the use of dopants in the emulsion crystals can be found in Research Disclosure, Item 38957 (September 1996), section I-D. Doping agents, generally in small quantities, such as rhodium, indium, osmium, iridium and ruthenium ions can be added and incorporated in a way as has further been disclosed in e.g. in U.S. Pat. Nos. 5,306,613; 5,399,476; in EP-A's 0 933 670, 0 933 671, 1 045 282 and in EP-A 1 058 150 and the corresponding U.S. Pat. No. 6,277,552. Incorporation of organic hole trapping dopants, e.g. making use of formic acid, rongalites etc., can also be applied as described in EP-A 0 922 994.

As is well-known gelatin is normally used as protective colloid for the silver halide emulsion crystals during precipitation. The preparation of conventional lime-treated or acid treated gelatin has been described in e.g. "The Science and Technology of Gelatin", edited by A. G. Ward and A. Courts, Academic Press 1977, page 295 and next pages. The gelatin can also be enzyme-treated as described in Bull. Soc. Sci. Phot. Japan, N° 16, page 30 (1966).

A preparation method of tabular grain emulsions wherein in the grain growth process use is made of gelatin derivatives with chemically modified $NH_2$-groups and wherein said gelatin has a specific methionine content has been described in e.g. EP-A 0 697 618. Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even cationic starch, whether or not in oxidized form. Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3),24(1967) may be used as a dispersion medium. Also the crystal habit restraining agent described in EP-A 0 534 395 may be used.

Part of gelatin may further be replaced with a synthetic or natural high-molecular material. An interesting substitute for gelatin may be silica as has been described in the published EP-A's 0 392 092, 0 517 961, 0 528 476, 0 649 051, 0 677 773 and 0 704 749.

For the precipitation processes wherein suitable silica sols are required as colloidal binder commercially available such as the "Syton" silica sols (a trademarked product of Monsanto Inorganic Chemicals Div.), the "Ludex" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 $\mu$m. The smaller particles in the range from 3 nm to 0.3 $\mu$m, and still more preferable from 3 nm up to 7 nm are preferred as the covering degree that can be achieved will be higher and as the protective action of the colloidal silica will be more effective.

At the end of the precipitation, following all possible physical ripening steps, the emulsion mixture is normally cooled to about 40° C., before or after adding a flocculate being a polymeric compound as e.g. polystyrene sulphonic acid, providing as a anionic polymer a behaviour depending on pH. Under carefully controlled conditions of addition and stirring rate the pH of the said dispersing medium is adjusted with an acid to a value in order to get a qualitatively good flocculate. Said flocculate may become decanted and washed with demineralized water in order to remove the soluble salts and the development inhibiting crystal habit modifier e.g. adenine to an allowable residual amount (preferably at most 0.3 mg/g of gelatin) or applying an ultrafiltration washing procedure as disclosed e.g. in Research Disclosure, Vol. 102, October 1972, Item 10208, Research Disclosure Vol. 131, March, Item 13122 and Mignot U.S. Pat. No. 4,334,012. Said ultrafiltration technique may be applied on-line during the whole precipitation, in order to reduce the increasing amount of water, thus avoiding dilution of the reaction vessel and increasing amounts of soluble salts like the mainly occurring potassium nitrate. Examples thereof have been described e.g. in EP-A 0 577 886. When the emulsion after precipitation is washed by diafiltration by means of a semipermeable membrane, a technique also called ultrafiltration, it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and U.S. Pat. No. 4,334,012. Redispersion may further be performed by addition of extra hydrophilic colloid. As a consequence values of gesi and/or sisi may be enhanced up to values desired in order to prepare stable coating solutions. It is clear however that any useful protective colloid cited hereinbefore as an alternative of gelatin or gelatin in modified form may be used.

As already set forth additional gelatin or another hydrophilic colloid, suitable as a binder material can be added at a later stage of the emulsion preparation as e.g. after washing, in order to establish optimal coating conditions and/or to establish the required thickness of the coated emulsion layer. Preferably a gelatin to silver halide ratio, silver halide being expressed as an equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure N° 38957 (1996), Chapter II.

Prior to coating any thickening agent may be used in order to regulate the viscosity of the coating solution, provided that they do not particularly affect the photographic characteristics of the silver chloroiodide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica. In order to coat hydrophilic colloidal layer compositions on a support by slide-hopper or curtain-coating techniques, wherein said compositions have gelatin in low amounts in order to provide a ratio by weight of gelatin to silver halide expressed as an equivalent amount of silver nitrate in the range from 0.05 to 0.4, thickening agents composed of synthetic clay and anionic macromolecular polyelectrolytes wherein said synthetic clay is present in an amount of at least 85% by weight versus the total amount of thickening agents are recommended as has been disclosed in EP-A 0 813 105.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxydioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Preferred hardening agents in the context of the present invention however are bis-(vinyl-sulphonyl)-methane (BVSME) and ethylene bis-(vinyl-sulphone).

A silver halide photographic material for use in the system of the present invention is thus provided, said material comprising on both sides a support, preferably symmetrically coated, at least one light-sensitive hydrophilic layer having a silver halide emulsion as disclosed hereinbefore.

Materials for use in the image-forming system according to the present invention, commonly have a hardening degree in order to have an absorption of water, as can be measured in a processing cycle after rinsing and before drying not, of not more than 2 g per g of gelatin coated. A lot of other ingredients are further required in order get suitable sensitometric properties, as e.g. sensitivity (also called speed), gradation (also called contrast) and fog in the preferred processing conditions for the materials coated from silver brom(oiod)ide emulsions used in the element according to the present invention.

In the radiographic system of the present invention two intensifying screens are disposed on each side of the radiographic element, wherein said screens do not emit visible light (as they generate more electrons as being electron intensifying screens). The said screens normally used are sheets of lead, lead oxide, or dense metals such as copper or steel. The thickness of these screens is between 0.025 mm and 0.50 mm, depending on the type of ionizing radiation used. In the system according to the present invention X- or γ-rays have an energy greater than or equal to 10 kVp as already set forth.

The radiographic image is obtained by exposing, to X- or γ-rays, either directly or through an intensifying screen as set forth above, a radiographic element which comprises a support covered on at least one side of the support material with a layer of silver halide emulsion grains comprising tabular grains having an aspect ratio greater than or equal to 2 and a tabular grain volume of at least 0.03 $\mu m^3$, and by developing the exposed element by making use of conventional processing methods or, in a more preferred embodiment, by "ecological" processing methods. With respect to said "ecological" processing methods, hardener-free black-and white developers are used, having ascorbic acid (as a more biodegradable developing agent instead of the conventional developing agents as dihydroxybenzene compounds or aminophenoles) as well as hardener-free fixers free from aluminum and/or ammonium salts, wherein said fixers further comprise a solvent for silver halides such as thiosulphate, thiocyanate or sulphurated organic compounds.

Essentially the element according to the present invention is free from spectrally sensitizing dyes as those are playing no role in capturing direct X-rays.

Compounds preventing formation of fog or stabilizing the photographic characteristics during the production or storage of the photographic elements or during the photographic treatment thereof are required and are, in most cases, already present during emulsion precipitation and/or chemical sensitization. Many known compounds can be added as fog-inhibiting agent or stabilizer to the silver halide emulsion layer or to other coating layers in water-permeable relationship therewith such as an undercoat or a protective layer. Suitable examples are e.g. those described in Research Disclosures N$^{os}$ 17643 (1978), Chapter VI and 38957 (1996), Chapter VII.

The photographic element may further comprise various kinds of coating physical property modifying addenda as described in Research Disclosure N° 38957 (1996), Chapter IX, wherein coating aids, plasticizers and lubricants, antistats and matting agents have been described.

Development acceleration can be accomplished by incorporating in emulsion layer(s) or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α,β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Research Disclosure N° 38957 (1996) Chapter VI, wherein also suitable optical brighteners are mentioned.

Spacing agents may be present of which, in general, the average particle size is comprised between 0.2 and 10 $\mu m$. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydro-phthalate. Other suitable spacing agents have been described in U.S. Pat. No. 4,614,708.

In direct X-ray photography the material normally has a duplitized emulsion layer coated on both sides (double-side coated) of the support. A mixture of two or more emulsions having silver brom(oiod)ide crystals with the same or different crystal sizes, the same or a different crystal habit, same or a different halide composition and/or a different or the same chemical ripening treatment, may be added to at least one light-sensitive emulsion layer, provided that (as an essential feature of the present invention) at least one emulsion (present in a sufficient amount in order to provide enough tabular grains, accounting for at least 50% of a total projective surface of said grains) has crystals ripened at least with a gold salt in order to provide the surface of said tabular grains with at least 6000 atoms of gold per $\mu m^2$ of its grain surface and per $(0.1\ \mu m \text{ of thickness})^2$ and at least a sulfite salt in such an amount that the ratio of the number of gold atoms per $\mu m^2$ and (concentration of said sulfite salt, expressed in mmole per mole of silver)$^2$ is at least 200000. According to a preferred embodiment of the present invention a material is thus provided, being a double-side coated material having same emulsion layers at both sides, coated per side with an amount of silver, expressed as an equivalent amount of silver nitrate in the range of from 5 up to 25 $g/m^2$.

Besides the light-sensitive emulsion layer(s) the photographic material may contain several light-insensitive layers at the side of the support carrying said light-sensitive emulsion layer(s), e.g. a protective antistress layer which can be split up into two layers, one of them being an underlying interlayer or an outermost afterlayer coated or sprayed on top of the "basic" protective antistress layer, one or more subbing layers, one or more intermediate layers, and even an afterlayer containing e.g. hardening agent(s), antistatic agent (s) and, optionally, filter dyes for safety-light purposes etc.

Protective antistress layers preferably contain coating aids and coating physical property modifying addenda mentioned in Research Disclosure N° 38957, published September 1996, Chapter IX. Antistatic properties are especially preferred in order to prevent blackening after processing in form of sparks, etc. due to abrupt decharging of electrostatic charges during production and/or handling before exposure and/or processing. It is highly preferred to add antistatic agents to the protective antistress layer or to an afterlayer coated thereupon as has been described e.g. in EP-A's 0 534 006, 0 644 454 and 0 644 456 and in U.S. Pat. Nos. 4,670,374 and 4,670,376. In another embodiment antistatic agents as polythiophenes, or oxides of vanadium, tin, etc., can also be added. Especially addition to the subbing layers of PEDT (a polythiophene) as described in EP 1 031 875 is recommended. Abrasion resistance of these outermost layers may be improved as described in U.S. Pat. Nos. 4,766,059 and 4,820,615. Spraycoating of afterlayers has been disclosed e.g. in U.S. Pat. No. 5,443,640. Measures in order to further suppress pressure sensitivity may be coating of enhanced amounts of binder as e.g. gelatin. This however is disadvantageous with respect to rapid processing, especially drying, but measures as set forth in U.S. Pat. No. 5,620,836 can also be applied in the present invention, offering however the particular advantage that less silver is coated in the elements according to the present invention as set forth hereinbefore. Moreover with respect to the binder material in the light-sensitive emulsion layer an improvement of pressure sensitivity can be expected if use is made therein from synthetic clays as has been disclosed in U.S. Pat. No. 5,478,709.

In addition thereto it is recommended to prepare aqueous solid dispersions in colloidal silica for any photographically useful compound as has been suggested e.g. in EP-A 0 569 074. Advantages with respect to thin layer coating and rapid processing ability can be expected with relation thereto, without enhancing pressure sensitivity of more vulnerable layers.

The support of the radiographic elements of the present invention preferably is a blue colored polyester support like polyethylene terephthalate. The thickness of such organic resin film is preferably about 175 $\mu m$. Other suitable hydrophobic resin supports are well known to those skilled in the art and are made e.g. of polystyrene, polyvinyl chloride, polycarbonate and polyethylene naphthalate. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. Nos. 3,397,988, 3,649,336, 4,123,278 and 4,478,907. A preferred layer arrangement wherein a subbing layer composition comprising as a latex copolymer vinylidene chloride, methylacrylate and itaconic acid has been covered with hydrophilic layers being at least one gelatinous dye containing layer comprising one or more dyes, at least one silver halide emulsion layer, at least one protective antistress layer, and optionally an afterlayer has been described in EP-A 0 752 617. In that invention said hydrophilic layers have a swelling ratio of not more than 200% and in said hydrophilic layers are coated simultaneously by the slide-hopper coating or by the slide-hopper curtain coating technique. Further information on suitable supports can be found in Research Disclosure No. 38957, Chapter XV, published September 1996.

According to the present invention a material is thus provided, wherein said material is a radiographic industrial non-destructive testing material. In another preferred embodiment according to the present invention said material is a material for personal monitoring. According to the present invention a personal electromagnetic radiation monitor is provided, said monitor being wearable by a person to warn the person of a radiation hazard condition caused by electromagnetic radiation emanating from a source of electromagnetic radiation, said monitor essentially comprising a material according to the present invention.

According to the present invention a system for industrial radiography is further offered, said system being comprised of (1) an industrial radiographic element as set forth herinbefore and (2) disposed on opposite sides of the radiographic element, two intensifying screens designed to emit electrons when exposed to X- or $\gamma$-rays with an energy greater than or equal to 10 kVp; more particularly with radiation having high energy, such as energies of 1.1 and 1.3 MeV as is the case for a Co-60 source or from a source for X-rays further comprising a high energy tube or even a synchrotron. High energy elementary particle radiation, generated from said high energy tube or from a synchrotron, as e.g. $\beta$-rays, electron beam or neutron radiation is useful in the context of the present invention.

According to the present invention a method is offered of providing an automated non-destructive test system to a manufacturing process, comprising the steps of providing at least one source for X-rays or $\gamma$-rays; and providing an object under test exposed to said X-rays or $\gamma$-rays, said object being operable to selectively absorb said X-rays or $\gamma$-rays.

Further according to the present invention a method for forming an industrial radiographic image has been provided, said method being comprised of (1) exposing the system disclosed hereinbefore to X- or $\gamma$-rays with an energy greater than or equal to 10 kVp to form a latent image and (2) developing the said latent image.

In a particularly preferred embodiment, according to the method for forming an industrial radiographic image of the present invention, said latent image is developed in a developing bath which contains ascorbic acid as developing agent. Information about such developers can be found e.g. in EP-A 0 732 619 and in U.S. Pat. Nos. 5,593,817; 5,604,082; 5,895,743 and 5,948,602; and in Research Disclosures Nos. 371052 (p. 185–224) and 352049 (p. 542–543), published Mar. 1, 1995 and Aug. 1, 1993 respectively.

In a further particularly preferred embodiment according to the method of the present invention said radiographic element is fully forehardened and the latent image is developed in a developing bath without further hardening. In practice this means that hydrophilic layers have a swelling ratio of not more than 200%, more preferably not more than 150%, and that in the processing cycle comprising the steps of developing, fixing, rinsing and drying, before drying and after the last rinsing step said material contains not more than 2 grams of water per gram of coated gelatin.

According to the present invention an image-forming method is thus offered, said method comprising the steps of exposing the system for industrial radiography disclosed hereinbefore and processing the material by the steps of developing, fixing, rinsing and drying. In one embodiment the image-forming method of the present invention comprises the step of processing said film material used in the image-forming system described hereinbefore, wherein said processing comprises the steps of developing in a developing solution comprising (iso)ascorbic acid, 1-ascorbic acid, reductic acid, salts and/or derivatives thereof; fixing in a fixer solution free from aluminum salts and, optionally, ammonium salts; rinsing and drying.

Replenishing said developing and fixer solution normally proceeds with amounts of replenisher in the range from 300 up to 900 ml/m$^2$, more preferably from 300 up to 600 ml/m$^2$, and from 400 up to 1200 ml/m$^2$, more preferably from 400 up to 700 ml/m$^2$, respectively. For the said processing, preferably an automatically operating apparatus is used provided with a system for automatic replenishment of the processing solutions. The processing therein proceeds within a relatively short processing time of from 1.5 up to 15 minutes from dry-to-dry, and more preferably, and realistic, from 3 up to 8 minutes, for materials used in the image forming system of the present invention as with the radiographic element according to the invention, it is possible to use silver contents up to 25% lower than the silver contents of the emulsions with thick or three-dimensional grains of the elements for industrial radiography.

A configuration suitable for use in the automatic processing apparatus shows the following consecutive tank units corresponding with, as consecutive solutions: developer-fixer-rinse water. In order to reduce "sludge formation" which is favored by solubilizing agents like sulfites, present in the developer as preservatives, a particularly suitable developer solution is the one comprising a reduced amount of sulfite and ascorbic acid which acts as a main developer and anti-oxidant as well and which is called "low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" which can be succesfully applied, have further been described in U.S. Pat. Nos. 5,447,817; 5,462,831 and 5,518,868.

A particularly suitable fixer solution comprises an amount of less than 25 g of potassium sulfite per liter without the presence of acetic acid wherein said fixer has a pH value of at least 4.5, in order to make the fixer solution quasi odourless. The presence of α-ketocarboxylic acid compounds may be useful as has been described in EP-A's 0 620 483 and 0 726 491 and in Research Disclosure No. 16768, published March 1978. It is possible to use sodium thiosulphate as a fixing agent, thus avoiding the ecologically undesired ammonium ions normally used. For the relatively low coating amounts of silver halide as in the elements of the present invention a fixation time which is reduced to about 100 seconds can be attained.

In another embodiment the developer solution used in the method according to this invention should be replenished not only for decrease of the liquid volume due to cross-over into the next processing solution but also for pH-changes due to oxidation of the developer molecules. This can be done on a regular time interval basis or on the basis of the amount of processed film or on a combination of both. In these circumstances, no dilution and mixing procedures are required before the regeneration bottles are adjusted to the processing unit. Moreover regeneration is kept to a minimum, especially in the processing of materials coated from lower amounts of emulsion crystals rich in silver bromide. Preferred minimum regeneration or replenishment amounts are from 300 up to 600 ml/m$^2$ for the developer solution and from 400 up to 700 ml/m$^2$ for the fixer solution. Replenishment of a developer comprising ascorbic acid or derivatives thereof and a 3-pyrazolidone derivative can be done as has been described in EP-A 0 573 700, wherein a method has been disclosed for processing with constant activity of image-wise exposed silver halide photographic material and wherein replenishing said developing solution proceeds by means of at least one replenishing solution having a higher pH than the developing solution. Other useful references related therewith, applicable with respect to the present invention, are e.g. EP-A's 0 552 511 and 0 660 175 and U.S. Pat. Nos. 5,503,965; 5,895,743 and 6,083,672.

The present invention is illustrated by the following examples, without however being limited thereto.

EXAMPLES

While the present invention will hereinafter be described in connection with preferred embodiments thereof, it will be understood that it is not intended to limit the invention to those embodiments.

Example I

In the present example combined gold/sulfite amounts were added in the chemical sensitization step to tabular silver bromoiodide crystals in order to look for effects encountered for the photographic properties of the said crystals when coated in hydrophilic light-sensitive layers of an industrial photographic material.

Preparation of tabular emulsion

To a solution of 5.5 g of oxidized gelatin (containing less than 30 μmole methionine per g) in 3 1 of demineralized water, adjusted to a pBr of 2.4 by adding KBr and a pH of 1.7 by adding $H_2SO_4$, were added by a double jet method aqueous solutions of 1.96 M $AgNO_3$ (hereinafter referred to as S1) and 1.96 M KBr (hereinafter referred to as S2) both at a constant flow rate of 16 ml/min. during 27 seconds. During this period, the reaction mixture was maintained at 51° C. When addition was completed, stirring continued during 1.5 minutes and followed by a temperature increase up to 70° C. over a period of 25 minutes, followed by addition of a NaOH solution over a period of one minute in order to adjust pH to a value of 5.6. Then stirring continued for 2.5 minutes and 0.5 l of a 10% gelatin solution kept at 70° C. was added. After stirring during another 5.5 minutes, S2 was added in a single jet at 7.5 ml/min over a period of 5.5 minutes. Then S1 at a constant flow rate of 7.5 ml/min and S2 at a flow rate, controlled in order to maintain pAg at 8.9, were added by double jet addition over a period of 1 minute. This double jet was continued during another period of 33 minutes and 23 seconds, while the flow rate of S1 was linearly increased up to 23.1 ml/min and pAg was maintained at 8.9. 5 minutes after the completion of said double jet addition, S1 was added at 7.5 ml/min during 7 minutes and 20 seconds. Then another double jet started of S1 at 7.5 ml/min during 1 minute and 40 seconds and an aqueous solution of 1.93 M KBr and 0.03 M KI at a controlled flow rate in order to maintain pAg at 7.4.

This double jet addition step was continued during another period of 40 minutes and 56 seconds, while the flow rate of S1 was linearly increased up to 36.8 ml/min, while pAg was maintained at a value of 7.4.

The tabular grains showed an average equivalent circular diameter (ECD) of 1.0 $\mu$m and an average thickness of 0.22 $\mu$m. The variation coefficient on said ECD was 0.30. The iodide content was 1 mole %, based on silver.

After ending the washing procedure, gelatin and water were added in order to obtain a silver halide content of 245 g/kg, expressed as an equivalent amount of $AgNO_3$, and the gelatin content of 83 g/kg. The pH was adjusted to a value of 6.0.

Chemical ripening

Per mole of AgBr(I) were consecutively added, with a time delay of 10 minutes between each addition, following products:

sodium thiosulphate, 0.85 ml of an aqueous solution containing 1 g/l of Na2S2O3.

HAuClO4.4H2O was added in quantities varying as indicated in the tables and was added as an aqueous solution containing $1.46\times10^{-3}$ M chlorauric acid and $1.58\times10^{-2}$ M ammonium thiocyanate.

$Na_2SO_3$ was added in quantities (in mmole per mole of AgBr(I)) as indicated in the Table as an aqueous solution containing $793\times10^{-3}$ moles of $Na_2SO_3$ per liter.

The emulsions were then heated for 4 hours at 52° C.

After cooling, a preservative was added.

Coating of the emulsion

Compounds added to the AgBr(I) emulsion, in g per mole of $AgNO_3$ were following:

TABLE I

| Compound | Amount in g per mole of AgNO3 |
|---|---|
| Gelatin | 63 g |
| 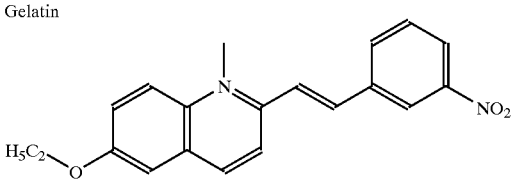 | 0.0075 g |
| 4-hydroxy-6-methyl-1,3,3a,7-tetra-azaindene | 0.824 g |
| Resorcinol | 3.828 g |
| Bis-metasulphophenyl-disulphide | 0.252 g |

Coating of the materials

The composition of the topcoat layer (protective antistress layer) with components and amounts in g per $m^2$ after coating have been given in Table II hereinafter.

The photographic materials according to these examples comprise one emulsion layer and one protective layer, coated symmetrically in the same way, at both sides of a blue colored polyethylene terephthalate support having a density for white light of 0.150. The coating solution of the emulsion layer was prepared by adding solutions of the compounds indicated in Table I to the emulsions, dissolved while warming and stirring. The coating solution of the protective layer is given in Table II. After adjusting the pH to 6.8, the viscosity of the coating solutions is optimized according to the requirements of the coating method.

The emulsion layer and the protective layer were simultaneously coated by means of the conventional slide hopper coating technique on one side of a subbed polyester support having a thickness of 175 $\mu$m. The silver coverage of the emulsions was 11.5 g/$m^2$, expressed as equivalent amount of $AgNO_3/m^2$ and per side.

TABLE II

| Compound | Amount in g/$m^2$ |
|---|---|
| Gelatin | 1.89 |
| Polymethylmethacrylate spacing agent (average particle diameter 3 mm) | 0.011 |
| Chromium acetate | 0.0077 |
| $CF_3$—$(CF_2)_6$—COOH.NH3 | 0.0074 |
| $CF_3$—$(CF_2)_6$—CONH—$CH_2CH_2O)_{17-20}$—H: | 0.020 |
| Mobilcer Q (a paraffin wax, trade name product from MOBIL OIL) | 0.023 |
| Polythioether A (modified poly-epichlorohydrine having an average chain length of approximately 20 monomer units and of which about 50% of the chloride groups have been replaced by a —S—$CH_2$—CHOH—$CH_2$OH substituent) | 0.042 |
| Bis-vinyl-sulfonyl methyl ether (added just before coating) | 0.130 |

Exposure conditions, processing conditions and determination of sensitometric parameters.

Samples of said coated and dried films were exposed to X-rays at a voltage of 86 kV and a current of 10 mA. The exposure times varied from 16 to 414 seconds.

Processing conditions:

After exposure the samples were processed manually in a tank (immersing times: developing during 5 minutes at 20° C.; fixing during 4 minutes at room temperature; rinsing during 15 minutes at room temperature; and drying) in a freshly prepared developer (G128, trademark product from Agfa-Gevaert N.V., Mortsel, Belgium) and in the same developer, but after exhaustion of said developer. The exhausted developer was simulated by processing, per liter of developer, 1.0 $m^2$ of the commercialy available Structurix D7 film—also trademark product from Agfa-Gevaert N.V., Mortsel, Belgium—without replenishing or adding fresh developer.

The difference in speed between the results obtained in fresh and in exhausted developer was considered as a measure for the developability of the photographic material; small differences being illustrative for a good ("stable" or "robust") developability, large differences being illustrative for a bad developability, strongly depending on developer composition and thus "unstable".

After processing following sensitometric parameters were determined:

(i) $D_{min}$: optical density in thousands of density units of a non-exposed sample including the density of the blue colored polyester layer layer;

(ii) Speed: measured as the log E value at a density of Dmin+2.0 (a lower figure stands for a higher speed).

Results of sensitometric tests have been summarized in Table III.

The number of gold atoms per per $\mu m^2$ of the grain surface for the lowest gold concentration was about 32000.

Calculation of number of atoms of gold per $\mu m^2$ of the grain surface and per (0.1 $\mu$m of thickness)$^2$ gave 6600; 12250 and 18900 for a concentration of 0.014, 0.026 and 0.040 mmole of gold salt per mole of silver respectively, whereas calculation of the ratio of the number of gold atoms per $\mu m^2$ per (concentration of said sulfite salt, expressed in mmole per mole of silver)$^2$ gave $3.2\times10^6$ and about 800000 for a concentration of sulfite salt of 0.1 and 0.2 mole per mole of silver respectively.

TABLE III

| | | Fresh G128 ® developer | | Exhausted developer | | Speed |
|---|---|---|---|---|---|---|
| | | $D_{min}$ ×1000 | Speed | $D_{min}$ ×1000 | Speed | Dif-ference |
| Structurix D7 4370041 | | 192 | 1.38 | 190 | 1.46 | −0.08 |
| $HAuClO_4$.4aq mmole/ mole of Ag | $Na_2SO_3$ mmole/ mole Ag | | | | | |
| 0.014 | 0 | 178 | 1.24 | 168 | 1.66 | −0.42 |
| 0.014 | 0.1 | 166 | 1.20 | 164 | 1.36 | −0.16 |
| 0.014 | 0.2 | 164 | 1.20 | 164 | 1.47 | −0.27 |
| 0.026 | 0 | 187 | 1.22 | 162 | 1.66 | −0.44 |
| 0.026 | 0.1 | 170 | 1.21 | 170 | 1.39 | −0.18 |
| 0.026 | 0.2 | 171 | 1.22 | 171 | 1.31 | −0.09 |
| 0.040 | 0 | 203 | 1.23 | 165 | 1.66 | 0.43 |
| 0.040 | 0.1 | 168 | 1.22 | 164 | 1.45 | −0.23 |
| 0.040 | 0.2 | 163 | 1.23 | 163 | 1.26 | −0.03 |

Table III shows that the highest amount of $HAuClO_4.4H_2O$ combined with the highest amount of $Na_2SO_3$ results in a lower loss of speed after exhausting the developer, per liter of developer, with 1.0 m2 of Structurix D7 material as set forth hereinbefore.

Presence of sulfite is a stringent requirement as is clear from the results presented hereinbefore in the Table III.

Example II

In this example the effect of an increasing "gold"-concentration and sulfite ($SO_3^{--}$)-concentration in the chemical ripening has been shown on thin tabular grains having a thickness of 0.09 $\mu$m.

Preparation of the tabular AgBr(I) emulsion

To a solution of 6.9 g of an oxidized gelatine in 3 l of demineralized water at 51° C., adjusted to a pH of 2.5 by adding H2SO4, stirred up to a rate of 600 r.p.m., were added by the double jet technique aqueous solutions of 0.98 M AgNO3 (hereinafter referred to as A1) and 0.98 M KBr (hereinafter referred to as B1): 25 ml of A1 and 25 ml of B1 were added in a time interval of 30 seconds. When the addition was completed, the temperature was increased up to 70° C. over a period of 30 minutes: UAg was controlled (expressed in mV versus a Ag/AgCl(sat.) reference electrode and should be in the range from 44.5+5 mV at a temperature of 70° C.±1° C. 1 minute later pH was set to a value of 5.0+0.3 and immediately thereafter a solution of 50 g of inert gelatin in 500 ml of demineralized water of 70° C. were added. 3 minutes later B1 was added at a rate of 7.06 ml/min. during 120 seconds, while simultaneously adding by double jet A1 at a rate of 7.5 ml/min.

In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the flow rate up to 46.49 ml/min. and 46.69 ml/min. respectively over a total time period of 81 minutes and 5 seconds.

After that double-jet addition period, an amount of an emulsion having ultrafine (ca. 0.040 $\mu$m) 100% AgI crystals, dissolved in 20 g of demineralized water at 40° C., was added to the reaction vessel in order to get a total silver iodide content at the end of precipitation of 0.1 mole % based on precipitated silver.

The average grain size of the silver bromoiodide tabular {111} emulsion grains thus prepared, expressed as equivalent circular diameter (E.C.D.) was 1.34 $\mu$m, whereas the average thickness was 0.09 $\mu$m. The variation coefficient of the said E.C.D. was 0.35.

After washing, gelatin and water were added in order to obtain a silver halide content of 245 g/kg, expressed as equivalent amount of AgNO3, and a gelatin content of 83 g/kg. pH was adjusted to 6.0.

The following part of the experimental procedure was the same as the procedure described in example I, except that the Ag content after coating was 20 g, expressed as equivalent amount of $AgNO_3/m^2$ and that during the chemical ripening 0.91 mmole of KSCN was added per mole of AgBr(I) 10 minutes before the addition of sodium thiosulphate (KSCN was added as a water solution containing 1.031 mole/liter.

0.0025 mmole of compound I was added per mol AgBrI 10 minutes after the addition of sodium thiosulphate. Compound I was added as a methanolic solution containing 1 g/l of said compound.

Compound I

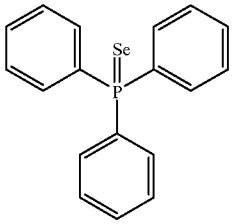

Sensitometric results have been summarized in Table IV.

Table IV hereinafter clearly shows that, as soon as a gold is present in the chemical ripening step in form of HAuClO4.4H2O in a concentration of 0.015 mmole/mole of $AgNO_3$ or more, in combination with at least 0.1 mmole of $Na_2SO_3$ a lower difference between speed in fresh and in exhausted chemistry of the developer is obtained.

The number of gold atoms per per $\mu m^2$ of the grain surface for the lowest gold concentration was about 4650.

Calculation of number of atoms of gold per $\mu m^2$ of the grain surface and per (0.1 $\mu$m of thickness)$^2$ gave 5750; 17250; 28750; 40250 and 51760 for a concentration of 0.005, 0.015, 0.025, 0.035 and 0.045 mmole of gold salt per mole of silver respectively, whereas calculation of the ratio of the number of gold atoms per $\mu m^2$ per (concentration of said sulfite salt, expressed in mmole per mole of silver)$^2$ gave about 931700 and 233000 for a concentration of sulfite salt of 0.1 and 0.2 mmole per mole of silver respectively.

TABLE IV

| | | Fresh G128 ® developer | | In exhausted developer | | Speed |
|---|---|---|---|---|---|---|
| | | $D_{min}$ ×1000 | Speed | $D_{min}$ ×1000 | Speed | Difference |
| Structurix D7 4370041 | | 202 | 1.40 | 196 | 1.48 | −0.08 |
| $HAuCl_4.4H_2O$ mmole/mole of Ag | $Na_2SO_3$ mmole/mole Ag | | | | | |
| 0.005 | 0 | 148 | 1.16 | 145 | 1.95 | −0.79 |
| 0.015 | 0 | 152 | 1.13 | 150 | 1.31 | −0.18 |
| 0.025 | 0 | 154 | 1.14 | 145 | 1.40 | −0.26 |
| 0.035 | 0 | 155 | 1.14 | 146 | 1.45 | −0.30 |
| 0.045 | 0 | 165 | 1.13 | 148 | 1.36 | −0.23 |
| 0.005 | 0.1 | 152 | 1.13 | 148 | 1.87 | −0.74 |
| 0.015 | 0.1 | 152 | 1.09 | 148 | 1.23 | −0.14 |
| 0.025 | 0.1 | 152 | 1.11 | 148 | 1.23 | −0.12 |
| 0.035 | 0.1 | 150 | 1.11 | 149 | 1.21 | −0.10 |
| 0.045 | 0.1 | 153 | 1.14 | 148 | 1.26 | −0.12 |
| 0.005 | 0.2 | 157 | 1.18 | 147 | 1.98 | −0.80 |
| 0.015 | 0.2 | 149 | 1.10 | 149 | 1.28 | −0.18 |
| 0.025 | 0.2 | 153 | 1.13 | 151 | 1.22 | −0.09 |
| 0.035 | 0.2 | 152 | 1.12 | 148 | 1.22 | −0.10 |
| 0.045 | 0.2 | 154 | 1.12 | 148 | 1.20 | −0.08 |

As is further clear from the results presented in the Table IV simultaneous presence of gold in minimum amounts of 0.010 mole per mole of silver (nitrate) and sulfite in minimum amounts of 0.1 mole per mole of silver (nitrate) is required in order to fully reach the objects of the present invention.

Having described in detail preferred embodiments of the current invention, it will now be apparent to those skilled in the art that numerous modifications can be made therein without departing from the scope of the invention as defined in the appending claims.

What is claimed is:

1. A system for direct X-ray radiography comprised of (1) a silver halide photographic element or material free from dyes spectrally sensitizing radiation sensitive emulsion grains coated in radiation sensitive layers thereof, said emulsion grains being tabular silver brom (oiod)ide grains with {111} major faces, an average equivalent circular diameter of at least 0.5 $\mu$m and an average thickness of less than 0.30 $\mu$m, said tabular grains accounting for at least 50% of the total projective area of all grains, said grains having been chemically sensitized by the steps of adding at least a gold salt in order to provide the surface of said tabular grains with at least 6000 atoms of gold per $\mu^2$ of its grain surface and per (0.1 $\mu$m of thickness)$^2$; and adding at least a sulfite salt in such an amount that the ratio of the number of gold atoms per $\mu m^2$ and per (concentration of said sulfite salt, expressed in mmole per mole of silver)$^2$ is at least 200000;

and wherein said emulsion has been coated in same emulsion layers at both sides of a double-side coated support, said element having, per side, an amount of silver, expressed as an equivalent amount of silver nitrate, in the range of from 5 up to 25 g/m$^2$;

said system further having, (2) disposed on opposite sides of said element, two intensifying screens designed to emit electrons when exposed to x- or γ-rays with an energy greater than or equal to 10 kVp. wherein said gold salt is added in an amount of at least 0.010 mmole per mole of silver and wherein said sulfite salt is added in an amount of at least 0.05 mmole per mole of silver.

2. System according to claim 1 wherein said ratio of number of gold atoms per $\mu m^2$ and per (concentration of said sulfite salt, expressed in mmole per mole of silver)$^2$ is in the range from $0.2\times10^6$ up to $3.5\times10^6$.

3. System according to claim 1 said tabular silver brom (oiod)ide emulsion grains having an average equivalent circular diameter of up to 2.0 $\mu$m and an average thickness of from 0.05 up to 0.25 $\mu$m.

4. System according to claim 1, said tabular silver brom (oiod)ide emulsion grains accounting for at least 75% of the total projective area of all grains.

5. System according to claim 1 wherein said material is an industrial non-destructive testing material.

6. System according to claim 1, wherein said element is a material for personal monitoring.

7. A personal electromagnetic radiation monitor wearable by a person in order to warn the person of a radiation hazard condition caused by electromagnetic radiation emanating from a source of electromagnetic radiation, said monitor essentially comprising an element or material used in the system according to claim 6.

8. Image-forming method comprising the steps of exposing to X- or γ-rays with an energy greater than or equal to 10 kVp an element provided in a system according to claim 1 and processing said element by the steps of developing, fixing, rinsing and drying.

9. Image-forming method according to claim 8, wherein in the step of developing ascorbic acid is present as developing agent.

* * * * *